United States Patent [19]

Obst

[11] Patent Number: 4,664,229

[45] Date of Patent: May 12, 1987

[54] MOTION DAMPENING COMPENSATING ELEVATOR CABLE

[75] Inventor: Donald L. Obst, Hickory, N.C.

[73] Assignee: Siecor Corporation, Hickory, N.C.

[21] Appl. No.: 749,639

[22] Filed: Jun. 28, 1985

[51] Int. Cl.[4] ..... B66B 9/00

[52] U.S. Cl. ..... 187/1 R; 187/94; 59/78

[58] Field of Search ..... 187/1 R, 94, 20, 21; 59/78, 82, 93; 428/328, 372, 373

[56] References Cited

U.S. PATENT DOCUMENTS

| | | | |
|---|---|---|---|
| 847,228 | 3/1907 | Bixby, Jr. | 59/78 |
| 1,360,456 | 11/1920 | Shiner | 59/78 |
| 3,342,036 | 9/1967 | Gruget | 428/328 X |
| 3,574,996 | 4/1971 | Loos | 59/78 |
| 3,768,596 | 10/1973 | Solymos | 187/21 |
| 3,991,856 | 11/1976 | Shigeta | 187/1 R |
| 4,243,710 | 1/1981 | Magrini | 428/208 |
| 4,247,594 | 9/1981 | Shea | 428/328 |
| 4,305,985 | 12/1971 | Heublein | 428/328 |

FOREIGN PATENT DOCUMENTS

| | | | |
|---|---|---|---|
| 501611 | 10/1951 | Belgium . | |
| 28014 | 10/1884 | Fed. Rep. of Germany . | |
| 366479 | 3/1922 | Fed. Rep. of Germany . | |
| 1781344 | 9/1970 | Fed. Rep. of Germany . | |
| 2307104 | 8/1973 | Fed. Rep. of Germany . | |
| 897155 | 5/1962 | United Kingdom . | |
| 1048306 | 10/1964 | United Kingdom | 187/1 R |

OTHER PUBLICATIONS

Elevator World; vol. 30; No. 2; published Feb. 1982.

*Primary Examiner*—Joseph J. Rolla
*Assistant Examiner*—Kenneth Noland
*Attorney, Agent, or Firm*—Roy B. Moffitt; J. David Abernethy

[57] ABSTRACT

An elevator compensating cable which has an elongated plastic tube shaped member which delimits a predetermined volume. Disposed within the predetermined volume are: (a) at least one elongated member; (b) an elongated means made from a mixture of metal particles of plastic; and (c) a plurality of elongated fibers adapted to move relative to one another, the strength member, and the elongated plastic tube shaped member, having a coefficient of elongation of not more than 30% and a coefficient of friction relative to all surrounding materials of not less than 0.3.

78 Claims, 8 Drawing Figures

MOTION DAMPENING COMPENSATING ELEVATOR CABLE

BACKGROUND AND BRIEF DESCRIPTION OF THE INVENTION

The basic elements of an elevator system are five fold, namely: a sheave, a counterweight, an elevator car, a compensating cable or counterweight, a hoist rope and a traveling cable. All of these elements are assembled in an elevator well or shaft in a well known manner. As a general rule the elevator car (or cab) is connected to the counterweight by a hoist rope threaded over one or more sheaves or pulleys in the upper reaches of the shaft. One end of the compensating cable is connected to the counterweight and the other to the bottom of the car, and in some cases, a "U" shaped portion therebetween is threaded over a compensating or guidance sheave located in the bottom of the elevator well. In most instances, however, the compensating cable is left to hang free without its midsection being threaded over a compensating or guidance sheave. One end of the traveling cable is connected to the car bottom and the other to a junction box affixed to an elevator sidewall over which signals are sent to a means causing the car to obey the commands sent thereover. The counterweight is essentially the same weight as the car and the weight of the hoist ropes essentially equal the weight of the compensating cable, as more fully disclosed hereafter.

The prime function of the compensating cable is to provide a dynamic counter balancing weight to the weight of the hoist rope(s) as the car goes up and down in the elevator shaft, i.e., to provide a dynamically balanced system. For optimum performance the aggregate weight of the hoist rope and traveling cable should be essentially equal to the weight of the compensating cable at any given position of the car in the elevator shaft. In addition, the length of the hoist rope between the car and and the overhead sheave should be equal to the length of the compensating cable between the counter weight and the lowest portion of the compensating chain or cable. Stated alternatively, the length of the hoist rope from car to counter weight is essentially equal to the length of the compensating cable from car to counter weight.

Before the recent introduction of an elevator compensating cable under the trademark "WHISPER-FLEX," prior art compensating cable usually were basically a link chain. Constantly raising and lowering of the elevator cab or car caused the chain to be raised and lowered, rubbing one link against another, resulting in noise and abrasion. Link chains when hung free in an elevator shaft (no bottom sheave) have a tendency to form a "point" and not a loop, i.e., the side legs of the chain tend to converge on a single link and form a point at the terminal "loop" formed by the chain. Such a configuration results in the propensity of one leg of the chain to rub against the other during car movement. Noise and abrasion result. More often than not, chain type compensating cable bang into the sidewalls of elevator shaft and cause damage and additional noise. Such noise was so much of a problem that some prior art compensating chain type cables either use a sash cord (a rope woven in the links of the chain) or employed a plastic coating over the link chain. One such commercially available compensating chain, sold under the mark "QUIET LINK" and advertised to reduce noise and the need for a sash cord, was a link chain disposed in a plastic sheath, the plastic sheath being drawn down as close as possible to the individual link members. See, for example, U.S. Pat. No. 3,574,996.

Disclosed in U.S. patent application Ser. No. 405,147 filed Aug. 8, 1982 entitled "Elevator Compensating Cable," is a solution to the problems previously encountered by the prior art at cab speeds of 350 fpm and less. However, at speed in excess of 350 fpm, several problems of unwanted cable motion arose, not previously recognized by the prior art. One problem was vertical or longitudinal vibrations encountered once an elevator cab came to a halt after a prior travel speed of over 350 fpm. The car and cable tend to vibrate slightly along the vertical axle of the elevator well, i.e., along the longitudinal axis of the compensating cable. Another and more significant problem not previously recognized by the prior art was the failure of the compensating cable to travel a truly "U" shaped path as the elevator car or cab went up and down at speeds in excess of 350 fpm. Motionless the compensating cable would ultimately hang true (a truly vertical "U" shaped) representing the lowest form of free energy of the cable. It would travel true at speeds of 350 fpm or less, but once the speed was increased beyond the 350 fpm barrier, the true vertical axis of the "U" shaped compensating cable began to deviate and lean to one side or the other (left or right) depending on whether the car was descending or ascending. For example, the vertical axis of the "U" shaped compensating cable would lean towards the leg of the "U" attached to the counter weight on descent and towards the leg of the "U" attached to the car on ascent.

Because of a "lean" (deviation of the vertical axis of the "U" shaped portion of a compensating cable from true vertical) one way or the other arising out of a car speed in excess of 350 fpm, there is a danger that the cable would collide with the sidewalls of the elevator shaft. Furthermore, upon stopping the car, the compensating cable attempted to seek a true vertical position (one of lowest free energy), thus setting up a pendulum or swinging action, resulting in a harmonic action in the cab and other cables attached thereto. One solution to such a problem is to use a guidance/stabilizer means (a sheave in the bottom of the elevator well), but this is expensive and shortens the wear life of the cable. A desirable solution would be one that does not require a guidance/stabilizer means and it is towards such a solution that the present invention is directed.

DETAILED DESCRIPTION OF THE INVENTION

Figure 1:
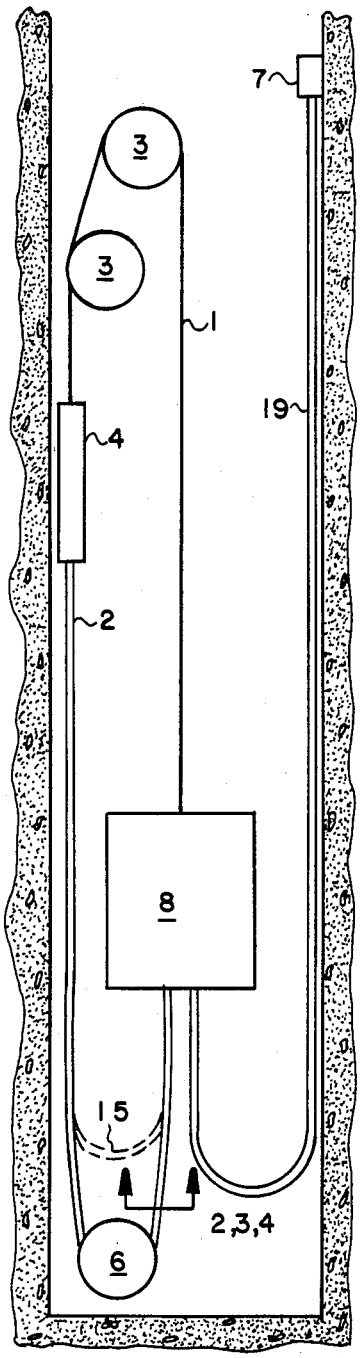
FIG. 1 is a cross sectional view of a schematic representation of an elevator system including a compensating member.

The instant invention concerns itself with a compensating cable sometimes called a counterweight rope. As shown in FIG. 1, compensating cable 2 is connected to the bottom of car 8 and to the bottom of counterweight 4. Sometimes, but not always, a compensating cable 2 may be traversed over sheave 6 or it may hang free in a "U" shaped or looplike configuration like control cable 19. See element 15. As a general rule, the length of compensating cable 2 (from car 8 to counterweight 4) should be essentially the same length as hoist rope 1, i.e., from car 8 over sheaves 3 to counterweight 4 [excluding wrap around portion around the sheave(s) if any]. Hoist rope 1 is connected to the roof of car 8, traversed over sheave 3 and connected to the top of counterweight 4. Because of safety factor reasons, there may be five or more hoist ropes and the aggregate weight of such hoist ropes should approximate the weight of compensating cable 2. This does not mean that if there are five hoist ropes, there must be five compensating cables. There may be only one compensating cable and a plurality of hoist ropes, so long as the length of compensating cable 2 (from car 8 to counterweight 4) is essentially the same as the distance, but not the aggregate distance, covered by all hoist ropes between car 8 and counterweight 4 and its weight is essentially equal to the aggregate weight of hoist ropes 1 and control cable 19. Control cable 19 has a weight that is usually negligible (compared to that of the hoist ropes), is terminated at junction box 7 and car 8, and is used to govern the car movement in a manner well known to the art.

Figure 2:
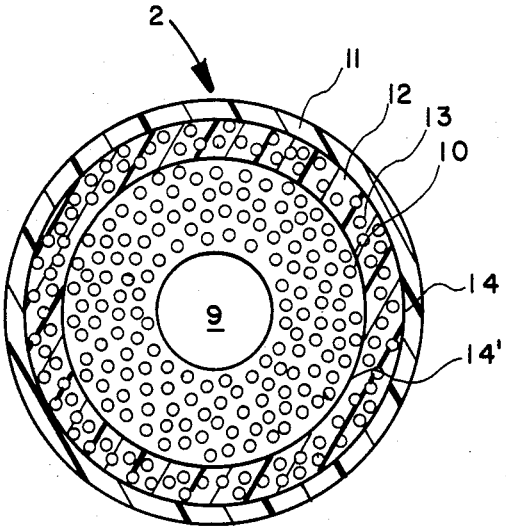
FIG. 2 is a cross sectional view of one embodiment of the compensating member 2 of FIG. 1 along line 2—2.

Turning to FIG. 2, element 2 is a cross section of the first embodiment of compensating cable 2. Plastic sheath 11 is a tubular shaped member made from either a polyamide, a polyolefin, polyvinyl chloride, rubber, polyurethane or mixtures thereof, in which there is disposed link chain 9 and element 14-14', the latter being a tube-like structure whose inner surface is denoted by element number 14' and outer surface is denoted by element member 14, made from plastic and metal particles. Link chain 9 is composed of a plurality of links interconnected one to another, see U.S. Pat. No. 3,574,996, for example. Nested inside of sheath 11 is a tube-shaped structure, 14-14' composed of metal particles 13 suspended in a plastic 12. The metal particles can be ferrous or non-ferrous of any desirable particle shape or size, preferably between 0.020 and 0.040 inches in diameter in an amount so that the volume delimited by element numbers 14-14' is 50 to 25% metal particles and likewise 50 to 75% is plastic by volume. Metals such as lead, iron, steel, copper and mixtures thereof have been found suitable for this purpose. The preferred particle size is such that all particles will pass an opening 0.0394 inches, 10% maximum will not pass a screen opening of 0.0331 inches, 85% minimum will not pass a screen opening of 0.0232 inches and 97% minimum will not pass a screen opening of 0.0197 inches. Some or all of such metal particles may be spherical and/or shapes other than spherical. The plastic may be any of the materials previously mentioned being suitable for the composition of sheath 11.

That volume delimited by the innermost surface 14' not otherwise occupied by link chain 9, is occupied by a plurality of elongated fibers 10 adapted to move relative to each other, strength member or link chain 9 and the tube surface 14' and have coefficients of elongation and friction of not more than 30% and not less than 0.03 respectively. Preferred materials for fibers 10 are jute, rayon, polyester, kevlar, or nylon.

Figure 3:
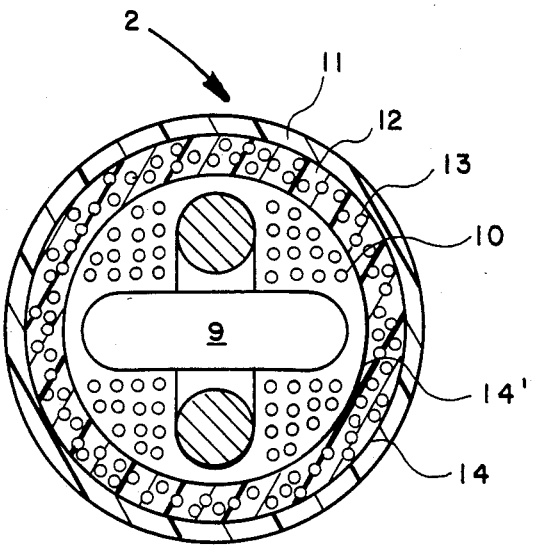
FIG. 3 is a cross sectional view of another embodiment of of the compensating member 2 of FIG. 2 along line 3—3.

In the embodiment of FIG. 3, a link chain strength member is used, dividing the volume delimited by surface 14' into four quadrants. Fibers 10 are disposed in such volume not otherwise occupied by chain 9 by placing a bundle of fibers 10 directly next to the point where the links of the chain intersect or contact one another and additional bundles are placed on top thereof until the volume delimited by the surface 14' not otherwise occupied by chain 9 is filled.

Figure 4:
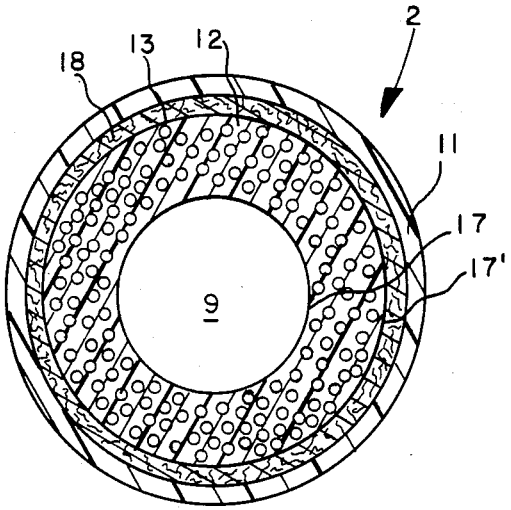
FIG. 4 is a cross sectional view of still another embodiment of member 2 of FIG. 1 along line 4—4.
Figure 5:
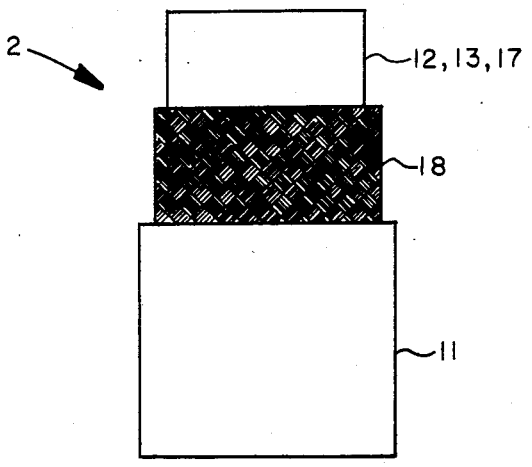
FIG. 5 is a cut away view of the embodiment of FIG. 4.

FIG. 4 is a cross sectional view of still another embodiment of compensating cable 2, using the same type of plastic sheath 11 as used by previously described embodiments. Nested inside sheath 11 is a cylindrically shaped core member composed of a strength member 9 circumscribed by tube member having inner surface 17 and outer surface 17' made from a mixture of plastic 12 and metal particles 13, having the same plastic to metal particles percentage by volume as previously described. Outer surface 17' delimits a tube having an outer diameter smaller than the internal diameter of sheath 11, thus the innermost surface of sheath 11 and the surface 17' delimit an annulus shaped space between the two into which a tubular shaped braid member 18 is disposed. Braid 18 is made in a prior art known manner out of the same fiberous materials 10 employed in the construction of the first two mentioned embodiments.

Apparatus used and the method of making the compensating chain 2 are known to the prior art. For example, U.S. Pat. No. 3,574,996 teaches the method and apparatus of extruding a sheath over a preform (a link chain). A preform composed of link chain 9 and metal plastic volume 12 and 13 is first formed by means of extrusion. Thereafter a plastic sheath may be extruded over the previously described preform.

A stranded metal wire rope may also be used as the strength member 9 instead of a link chain. Most any commercially available wire rope has been found to be suitable, especially those made from twisted or stranded filaments of steel. Wire rope made from high tensile strength nylons and aramids are also suitable.

It is believed that the energy creating the "lean," oscillations and noises of the prior art compensating cable arising out of cable (or car) speeds in excess of 350 fpm is absorbed by the fibers in the form of heat arising out of friction between the fibers during movement above 350 fpm. This heat is quickly dissipated to the surrounding atmosphere in a harmless manner, thereby solving a problem unforeseen by the prior art.

Figure 6:
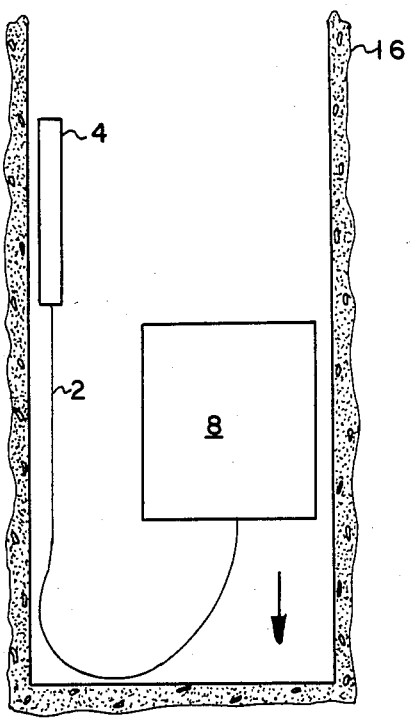
FIGS. 6 and 7 are cross sectional schematic views of the "lean" in prior art compensating cable arising from elevator system coming to a stop after traveling at a speed greater than 350 fpm.
Figure 7:
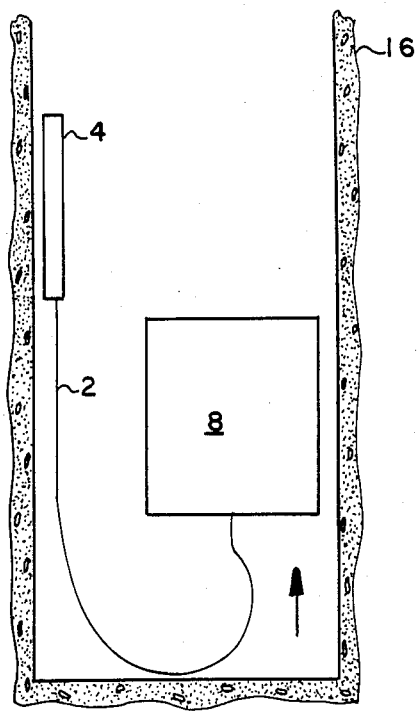
Figure 8:
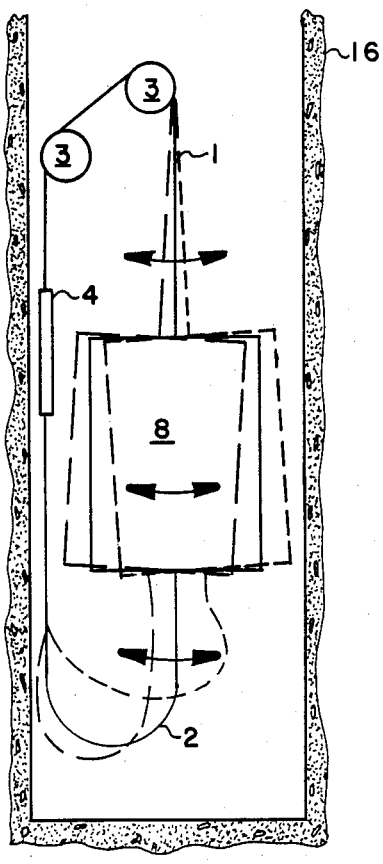
FIG. 8 is a cross sectional schematic view of a prior art elevator system oscillating in the indicated directions after deceleration of the system to a stop from a speed greater than 350 fpm.

When a cab/cable system comes to a halt after traveling at speeds in excess of 350 fpm, the car and cable tend to vibrate slightly along the vertical axle of the elevator well, i.e., along the longitudinal and axis of the compensating cable. Another and more significant problem, not heretofore recognized by the prior art, was the failure of the compensating cable to travel a truly U-shaped path as the elevator car or cab went up and down at speeds in excess of 350 fpm. Motionless, the compensating cable would ultimately hang true in a vertical U-shape representing the lowest form of free energy of the cable. At speeds greater than 350 fpm, the true vertical axis of the U-shape compensating cable deviates from a true U-shape and leans to one side or another, depending upon whether the car is descending or ascending. For example, in FIG. 6, the vertical axis of the U-shaped compensating cable 2 leans towards the leg of the U attached to the counterweight 4 on descent; and as shown in FIG. 7, it leans towards the leg of the U attached to the car 8 on ascent at speeds of 350 fpm. When the upward or downward motion of the elevator car 8 ceases, compensating cable 2 swings back and forth in the direction of car 8 and then counterweight 4 in a pendulum-like motion. This motion, in turn, causes elevator car 8 and hoist rope 1 to swing also, since the system hangs freely from hoist rope 1. See FIG. 8. There may even be a slight vertical motion of car 8. These resulting motions of car 8 are uncomfortable for any passengers which may be aboard, and, more importantly, are dangerous since they may cause one of the cables or the car to come in contact with or snag the elevator shaft 16, or something attached to the shaft, and shorten the useful life of the hoist rope and compensating cable due to the wear and tear caused by the vibrations. The fibers in the compensating cable shown in the two embodiments tend to minimize any lean toward one side or the other in the compensating cable, but also dampen any pendulum type motions arising out of a car 1 cable system traveling at speeds of 350 fpm and greater coming to a halt, giving rise to a safer, more comfortable elevator system.

What is claimed is:

1. An elongated member comprising an elongated plastic tube-shaped member delimiting a predetermined volume containing:

(a) at least one elongated strength member disposed in and occupying less than all the said predetermined volume;

(b) an elongated means made from a mixture of metal particles embedded in plastic disposed in and occupying less than all of the predetermined volume not otherwise occupied by the strength member; and, (c) a plurality of elongated fibers adapted to move relative to one another, the strength member and the elongated plastic tube-shaped member, having a coefficient of elongation of not more than 30% and a coefficient of friction relative to all surrounding materials of not less than 0.3 disposed in that portion of the predetermined volume not otherwise occupied by the strength member and the elongated means made from metal particles embedded in plastic.

2. The elongated member of claim 1 wherein said elongated strength member is either a stranded wire rope or a link chain.

3. The elongated member of claim 1 wherein said tube-shaped member is composed of a material selected from the group consisting of rubber, polyamides, polyurethane, polyvinyl chloride, polyolefins, and mixtures thereof.

4. The elongated member of claim 1 comprising a plurality of elongated strength members.

5. The elongated member of claim 4 wherein the elongated strength members are either all link chains or stranded wire ropes or a combination of at least one link chain and one stranded wire rope.

6. The elongated member of claim 1 wherein said metal particles are either ferrous or nonferrous metals or mixtures thereof and at least some of which are spherical in shape.

7. The elongated member of claim 1 wherein said metal particles are steel and have a particle size between 0.02 and 0.04 inches.

8. The elongated member of claim 1 wherein the elongated means is 50 to 25 percent metal particles by volume.

9. The elongated member of claim 1 wherein the elongated means is 50 to 75 percent plastic by volume.

10. The elongated member of claim 1 wherein the plastic of the elongated means is selected from the group consisting of rubber, polyolefins, polyvinyl chloride, polyamides, polyurethane, and mixtures thereof.

11. The elongated member of claim 1 wherein the particle size of said metal particles is such that it will pass a screen having screen openings of 0.0394 inches.

12. The elongated member of claim 1 wherein said strength member is made from materials selected from the group comprising steel, iron, polyamides, aramids and graphite.

13. The elongated member of claim 1 wherein said fibers are woven into a braid.

14. An elongated member comprising:

(a) a first elongated plastic tube-shaped member;

(b) a second elongated tube-shaped member axially nested inside of the first elongated plastic tube-shaped member made from a mixture of plastic and metal particles having an innermost surface delimiting a predetermined volume;

(c) at least one elongated strength member disposed in and occupying less than all of said predetermined volume; and, (d) a plurality of elongated fibers adapted to move relative to (i) one another, (ii) the strength member and (iii) the second elongated tube-shaped member, having a coefficient of elongation of not more than 30% and a coefficient of friction relative to surrounding materials of not less than 0.3 disposed in that portion of the predetermined volume not otherwise occupied by the strength member.

15. The elongated member of claim 14 wherein said elongated strength member is either a stranded wire rope or a link chain.

16. The elongated member of claim 14 wherein said first elongated tube-shaped member is composed of a material selected from the group consisting of rubber, polyamides, polyurethane, polyvinyl chloride, polyolefins, and mixtures thereof.

17. The elongated member of claim 14 wherein there is a plurality of elongated strength members.

18. The elongated member of claim 17 wherein said elongated strength members are either all link chains or stranded wire ropes or a combination of at least one link chain and one stranded wire rope.

19. The elongated member of claim 14 wherein said metal particles are either ferrous or nonferrous metals or mixtures thereof and at least some of which are spherical in shape.

20. The elongated member of claim 14 wherein said metal particles are steel and have a particle size between 0.02 and 0.04 inches.

21. The elongated member of claim 14 wherein the second elongated tube-shaped member is 50 to 25 percent metal particles by volume.

22. The elongated member of claim 14 wherein the second elongated tube-shaped member is between 50 and 75 percent plastic by volume.

23. The elongated member of claim 14 wherein the plastic of the second elongated tube-shaped member is selected from the group consisting of rubber, polyolefins, polyvinyl chloride, polyamides, polyurethane, and mixtures thereof.

24. The elongated member of claim 14 wherein the particle size of said metal particles is such that it will pass a screen having screen openings of 0.0394 inches.

25. The elongated member of claim 14 wherein said strength member is from materials selected from the group comprising steel, iron, polyamides, aramids and graphite.

26. The elongated member of claim 14 wherein said fibers are woven into a braid.

27. An elongated member comprising:

(a) an elongated plastic tube-shaped member having an innermost surface delimiting a first predetermined volume;

(b) an elongated cylindrically shaped core member composed of an elongated strength member encased in a body made from a mixture of plastic and metal particles disposed in the first predetermined volume having an outermost surface spaced apart from the innermost suface of the elongated plastic tube-shaped member thereby delimiting a second predetermined volume there between; and, (c) a tube-like member disposed in the second predetermined volume composed of a plurality of elongated fibers adapted to move relative to (i) one another, (ii) the outermost surface of the cylindrical shaped core member and (iii) the innermost surface of the elongated plastic tube-shaped member, having a coefficient of elongation of not more than 30% and a coefficient of friction with surrounding materials of not less than 0.3.

28. The elongated member of claim 27 wherein said elongated strength member is either a stranded wire rope or a link chain.

29. The elongated member of claim 27 wherein said elongated plastic tube-shaped member is composed of a material selected from the group consisting of rubber, polyamides, polyurethane, polyvinyl chloride, polyolefins, and mixtures thereof.

30. The elongated member of claim 27 wherein there is a plurality of elongated strength members.

31. The elongated member of claim 30 wherein said elongated strength members are either all link chains or stranded wire ropes or a combination of at least one link chain and one stranded wire rope.

32. The elongated member of claim 27 wherein said metal particles are either ferrous or nonferrous metals or mixtures thereof and at least some of which are spherical in shape.

33. The elongated member of claim 27 wherein said metal particles are steel and have a particle size between 0.02 and 0.04 inches.

34. The elongated member of claim 27 wherein said body is 50 to 25 percent metal particles by volume.

35. The elongated member of claim 27 wherein said body is 50 to 75 percent plastic by volume.

36. The elongated member of claim 27 wherein the plastic of the body volume is selected from the group consisting of rubber, polyolefins, polyvinyl chloride, polyamides, polyurethane, and mixtures thereof.

37. The elongated member of claim 27 wherein the particle size of said metal particles is such that it will pass a screen having screen openings of 0.0394 inches.

38. The elongated member of claim 27 wherein said strength member is from materials selected from the group comprising steel, iron, polyamides, aramids and graphite.

39. The elongated member of claim 27 wherein said fibers are woven into a braid.

40. An elevator system comprising a car, a compensating member, a counterweight, and a hoist rope, the hoist rope being connected to the car and the counterweight, the compensating member connected to the counterweight and the car, the improvement wherein said compensating member is composed of an elongated member comprising an elongated plastic tube-shaped member delimiting a predetermined volume containing:

(a) at least one elongated strength member disposed in and occupying less than all the said predetermined volume;

(b) an elongated means made from a mixture of metal particles embedded in plastic disposed in and occupying less than all the said predetermined volume not otherwise occupied by the strength member; and, (c) a plurality of elongated fibers adapted to move relative to one another, the elongated means, the strength member and the elongated plastic tube-shaped member, having a coefficient of elongation of not more than 30% and a coefficient of friction relative to all surrounding materials of not less than 0.3 disposed in that portion of the predetermined volume not otherwise occupied by the strength member and the elongated means.

41. The elevator system of claim 40 wherein said elongated strength member is either a stranded wire rope or a link chain.

42. The elevator system of claim 40 wherein said sheath is composed of a material selected from the group consisting of rubber, polyamides, polyurethane, polyvinyl chloride, polyolefins, and mixtures thereof.

43. The elevator system of claim 40 wherein there are a plurality of elongated strength members.

44. The elevator system of claim 40 wherein said metal particles are either ferrous or nonferrous metals or mixtures thereof and at least some of which are spherical in shape.

45. The elevator system of claim 40 wherein said metal particles are steel and have a particle size between 0.02 and 0.04 inches.

46. The elevator system of claim 40 wherein the elongated means is 50 to 25 percent metal particles by volume.

47. The elevator system of claim 40 wherein the elongated means is 50 to 75 percent plastic by volume.

48. The elevator system of claim 40 wherein the plastic of the elongated means is selected from the group consisting of rubber, polyolefins, polyvinyl chloride, polyamides, polyurethane and mixtures thereof.

49. The elevator system of claim 40 wherein the particle size of said metal particles is such that it will pass a screen having screen openings of 0.0394 inches.

50. The elevator system of claim 40 wherein said compensating member contains a plurality of elongated strength members which are either all link chains or stranded wire ropes, or a combination of at least one link chain and one stranded wire rope.

51. The elevator system of claim 40 wherein said fibers are woven into a braid.

52. The elevator system of claim 40 wherein said strength member is made from materials selected from the group comprising steel, iron, polyamides, aramids and graphite.

53. An elevator system comprising a car, a compensating member, a counterweight, and a hoist rope, the hoist rope being connected to the car and the counterweight, the compensating member connected to the counterweight and the car, the improvement wherein said compensating member is composed of an elongated member comprising:

(a) a first elongated plastic tube-shaped member;

(b) a second elongated tube-shaped member axially nested inside of the first elongated plastic tube-shaped member made from a mixture of plastic and metal particles and delimiting a predetermined volume;

(c) at least one elongated strength member disposed in and occupying less than all of said predetermined volume; and, (d) a plurality of elongated fibers adapted to move relative to (i) one another, (ii) the strength member and (iii) the second elongated tube-shaped member, having a coefficient of elongation of not more than 30% and a coefficient of friction relative to surrounding materials of not less than 0.3 disposed in that portion of the predetermined volume not otherwise occupied by the strength member.

54. The elevator system of claim 53 wherein said elongated strength member is either a stranded wire rope or a link chain.

55. The elevator system of claim 53 wherein the first elongated tube-shaped member is composed of a material selected from the group consisting of rubber, polyamides, polyurethane, polyvinyl chloride, polyolefins, and mixtures thereof.

56. The elevator system of claim 53 wherein there is a plurality of elongated strength members.

57. The elevator system of claim 53 wherein said metal particles are either ferrous or nonferrous metals or mixtures thereof and at least some of which are spherical in shape.

58. The elevator system of claim 53 wherein said metal particles are steel and have a particle size between 0.02 and 0.04 inches.

59. The elevator system of claim 53 second elongated tubeshaped member is 50 to 25 percent metal particles by volume.

60. The elevator system of claim 53 wherein the second elongated tube-shaped member is 50 to 75 percent plastic by volume.

61. The elevator system of claim 53 wherein the plastic of the second elongated tube-shaped member is selected from the group consisting of rubber, polyolefins, polyvinyl chloride, polyamides, polyurethane and mixtures thereof.

62. The elevator system of claim 61 wherein said strength member is made from materials selected from the group comprising steel, iron, polyamides, aramids and graphite.

63. The elevator system of claim 53 wherein the particle size of said metal particles is such that it will pass a screen having screen openings of 0.0394 inches.

64. The elevator system of claim 53 wherein said compensating member contains a plurality of elongated strength members which are either all link chains or stranded wire ropes, or a combination of at least one link chain and one stranded wire rope.

65. The elevator system of claim 53 wherein said strength member is made from materials selected from the group comprising steel, iron, polyamides, aramids and graphite.

66. The elevator system of claim 53 wherein said fibers are woven into a braid.

67. An elevator system comprising a car, a compensating member, a counterweight, and a hoist rope, the hoist rope being connected to the car and the counterweight, the compensating member connected to the counterweight and the car, the improvement wherein said compensating member is composed of an elongated member comprising:

(a) an elongated plastic tube-shaped member having an innermost surface delimiting a first predetermined volume;

(b) an elongated cylindrically shaped core member composed of an elongated strength member encased in a body made from a mixture of plastic and metal particles disposed in the first predetermined volume and spaced apart from the innermost suface of the elongated plastic tube-shaped member, delimiting a second predetermined volume there between; and, (c) a tube-like member disposed in the second predetermined volume composed of a plurality of elongated fiber adapted to move relative to (i) one another, (ii) the cylindrical shaped core member and (iii) the innermost surface of the elongated plastic tube-shaped member, having a coefficient of elongation of not more than 30% and a coefficient of friction with surrounding materials of not less than 0.3.

68. The elevator system of claim 67 wherein said elongated strength member is either a stranded wire rope or a link chain.

69. The elevator system of claim 67 wherein said elongated plastic tube-shaped member is composed of a material selected from the group consisting of rubber, polyamides, polyurethane, polyvinyl chloride, polyolefins, and mixtures thereof.

70. The elevator system of claim 67 comprising a plurality of elongated strength members.

71. The elevator system of claim 67 wherein said metal particles are either ferrous or nonferrous metals or mixtures thereof and at least some of which are spherical in shape.

72. The elevator system of claim 67 wherein said metal particles are steel and have a particle size between 0.02 and 0.04 inches.

73. The elevator system of claim 67 wherein the body is 50 to 25 percent metal particles by volume.

74. The elevator system of claim 67 wherein the body is 50 to 75 percent plastic by volume.

75. The elevator system of claim 67 wherein the plastic comprising the core member is selected from the group consisting of rubber, polyolefins, polyvinyl chloride, polyamides, polyurethane and mixtures thereof.

76. The elevator system of claim 67 wherein the particle size of said metal particles is such that it will pass a screen having screen openings of 0.0394 inches.

77. The elevator system of claim 67 wherein said compensating member contains a plurality of elongated strength members which are either all link chains or stranded wire ropes, or a combination of at least one link chain and one stranded wire rope.

78. The elevator system of claim 67 wherein said fibers are woven into a braid.

* * * * *